US009033787B2

(12) United States Patent
Hodgson et al.

(10) Patent No.: US 9,033,787 B2
(45) Date of Patent: May 19, 2015

(54) METHOD OF AND MACHINE FOR PLAYING A GAME WITH AREA AND NUMERIC WINNING THRESHOLDS

(75) Inventors: Lawrence J. Hodgson, Kildeer, IL (US); Leonid Smikun, Glenview, IL (US)

(73) Assignee: Incredible Technologies, Inc., Arlington Heights, IL (US)

( * ) Notice: Subject to any disclaimer, the term of this patent is extended or adjusted under 35 U.S.C. 154(b) by 82 days.

(21) Appl. No.: 13/414,996

(22) Filed: Mar. 8, 2012

(65) Prior Publication Data

US 2012/0238344 A1 Sep. 20, 2012

Related U.S. Application Data

(60) Provisional application No. 61/453,264, filed on Mar. 16, 2011.

(51) Int. Cl.
*A63F 3/06* (2006.01)
*G07F 17/32* (2006.01)

(52) U.S. Cl.
CPC ..... *G07F 17/3213* (2013.01)

(58) Field of Classification Search
CPC ..... A63F 3/081
USPC ..... 463/18, 16, 17; 273/269
See application file for complete search history.

(56) References Cited

U.S. PATENT DOCUMENTS

| | | | | |
|---|---|---|---|---|
| 5,909,875 | A * | 6/1999 | Weingardt | 273/269 |
| 6,270,407 | B1 * | 8/2001 | Dodge | 463/18 |
| 6,315,291 | B1 * | 11/2001 | Moody | 273/139 |
| 2006/0183531 | A1 * | 8/2006 | Thomas | 463/18 |
| 2007/0155470 | A1 * | 7/2007 | Brunelle et al. | 463/18 |

* cited by examiner

*Primary Examiner* — Damon Pierce
(74) *Attorney, Agent, or Firm* — Husch Blackwell LLP

(57) ABSTRACT

A method and gaming machine for playing a game with area and numerical winning thresholds. The method and machine present a plurality of distinct elements which are grouped into a plurality of subsets whereby a player can select both a sub-plurality of elements and at least one subset. A set of random elements is selected from the set of elements which also determines at least one random subset. The set of random elements is compared to the sub-plurality of player selected elements and the player selected subset to the random subset. A player is rewarded if the set of random elements and the set of player selected elements have a pre-determined minimum number of common elements and/or if the plurality of player selected subsets and the plurality of random subsets have a second, pre-determined minimum number of common subsets.

15 Claims, 6 Drawing Sheets

I

| | | | | | | | |
|---|---|---|---|---|---|---|---|
| 1 | 2 | 3 | 4 | 5 | 6 | 7 | 8 |
| 9 | 10 | 11 | 12 | 13 | 14 | 15 | 16 |
| 17 | 18 | 19 | 20 | 21 | 22 | 23 | 24 |
| 25 | 26 | 27 | 28 | 29 | 30 | 31 | 32 |
| 33 | 34 | 35 | 36 | 37 | 38 | 39 | 40 |
| 41 | 42 | 43 | 44 | 45 | 46 | 47 | 48 |
| 49 | 50 | 51 | 52 | 53 | 54 | 55 | 56 |
| 57 | 58 | 59 | 60 | 61 | 62 | 63 | 64 |

| | | | | | |
|---|---|---|---|---|---|
| ENTER SELECTIONS: | | | | | |
| NUMBERS DRAWN: | | | | | |

*FIG. 2*

METHOD OF AND MACHINE FOR PLAYING A GAME WITH AREA AND NUMERIC WINNING THRESHOLDS

CROSS REFERENCE TO RELATED APPLICATION

This application claims the benefit of U.S. Provisional Patent Application Ser. No. 61/453,264 filed Mar. 16, 2011, the entirety of which is incorporated herein by reference.

FIELD

The invention pertains to electronic game playing machines and methods of play. More particularly, the invention pertains to such machines and methods which implement a multi-choice card-type game.

BACKGROUND

Multi-choice card-type games, such as bingo or keno are played by individuals for a variety of reasons including entertainment and the challenge of winning. While both types of games can provide awards to winners, keno requires only a single player and can provide excitement and entertainment for that player via a single electronic version of the game.

Multiple players can be entertained simultaneously by means of a plurality of independently operated game machines. In such environments, each player independently plays against the house.

Games such as keno to a great extent have a standardized format which over a period of time can produce a drop in player excitement and interest. Hence there are on-going needs to try to bring play variations to the audience of players to sustain their interest and desire to continue playing.

BRIEF DESCRIPTION OF THE DRAWINGS

FIG. 2 illustrates an initial configuration of a keno card, which could be displayed electronically by the apparatus of FIGS. 1, 1A with the allowable number selections divided into four subareas;

DETAILED DESCRIPTION

Figure 1:
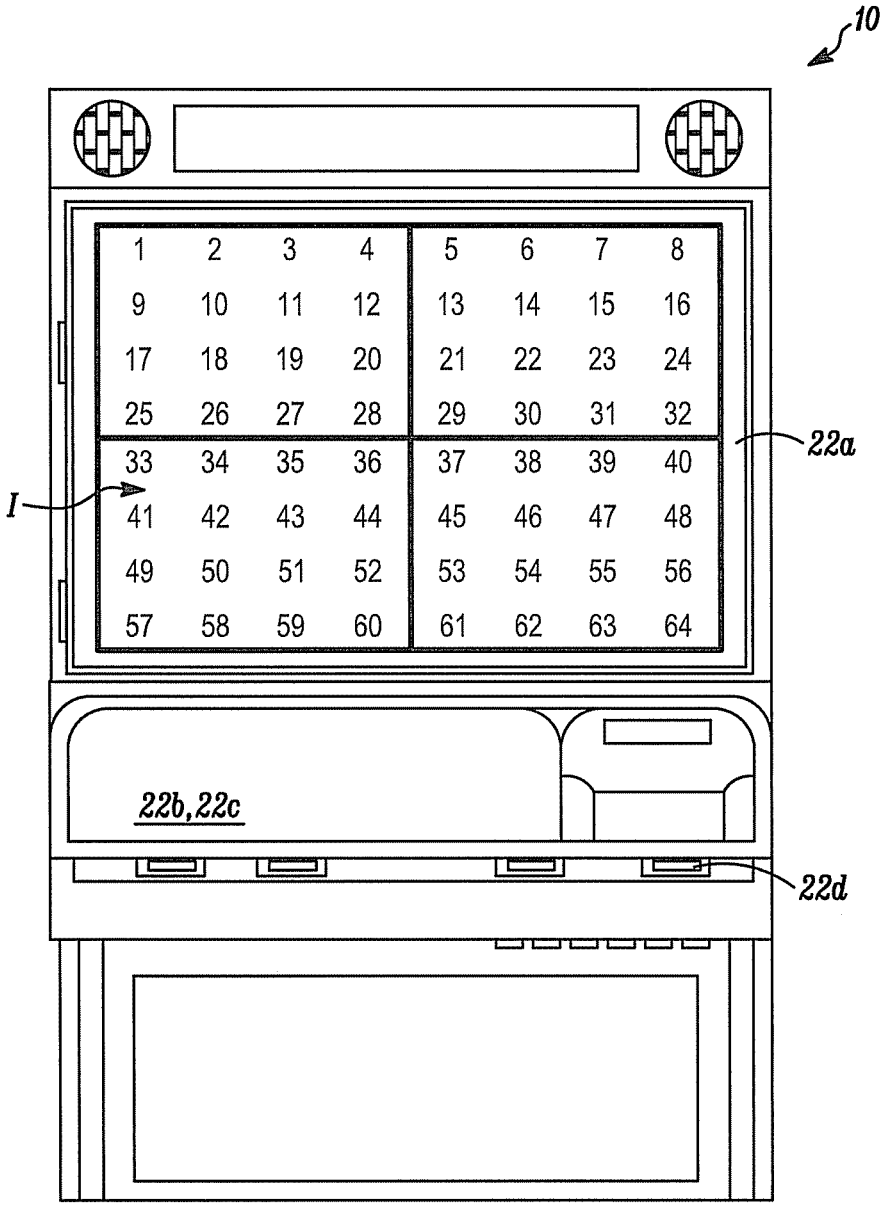
FIG. 1 is an over-all view of a gaming apparatus in accordance herewith.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Embodiments of the invention provide a method for playing a game with area and numerical winning thresholds. In another aspect, a machine for playing a game with area and numerical winning thresholds is provided. In yet another aspect, an entertaining variation on previously known games can be provided by introducing area and numerical winning thresholds.

In disclosed embodiments, variations on games are provided which evaluate the outcome of the game based upon a drawing of a fixed subset of elements from a fixed set of elements and comparing the result to a player's pre-chosen selection of a predicted subset. The most common example of such a gambling game is "keno," where a player selects a fixed number of sub-elements from a fixed set of elements (typically numbers from 1 to some reasonable upper limit such as 64 or 100) and then compares their selection to a random selection of numbers from the same set, with a prize being awarded for matching a pre-stated number of the randomly selected numbers.

In addition to enabling the player to win only by matching a minimum number of the randomly selected elements, the present invention teaches a method of combining the combination of such a method with a supplemental method of dividing the fixed set of elements into a plurality of geometric areas. Each geometric area can contain a fixed subset of the fixed set of elements. Players can win by wagering on possible outcomes of the distribution of the randomly selected elements in the geometric areas thereby increasing excitement and interest in the game.

As the invention is particularly suitable for play on an electronic device, a device, or gaming machine, incorporating the method of play is also disclosed herein.

While the description of the disclosed embodiment relates to the game commonly known as "Keno," those of skill will understand that alternate embodiments could be used in any desired gaming or entertainment device, including but not limited to a video poker game, a combination gaming machine, or even a coin-operated or bar-top amusement device.

The description of the preferred embodiment further refers to the elements as "numbers," since those are what are typically used to play Keno, to a selection of random numbers as a "draw," and to the evaluation groupings as "cards" likewise. If the invention were applied to a dice game, the evaluation objects would be individual dice, draws would be groups of dice as they fell in a preselected area or areas for rolling the dice, and so forth. Wherever the term "numbers" is used, it should be understood to mean "the appropriate individual members of the set of elements," the term "draw" should be understood to mean "a single random selection of a subset of members of the set of elements," and the term "card" or "cards" should be understood to mean, "a method for arranging the set of elements in a predetermined way."

Before play begins, both a predetermined minimum number of matching numbers which will award a minimum matching prize, and a predetermined area or areas of the card which will award a minimum area matching prize should be specified. A pay value—usually a multiple of the initial wager, can also be assigned to all possible outcomes of number matches and/or area matches.

For draws with no number matches and no area matches, this would normally be zero. Although it is not required, it is preferred that this be the case for ease of understanding by the player and mathematical simplicity of the game.

For draws with at least one number match and/or at least one area match, it may be constant, or related to the number of number matches and/or the prevalence of the geometrical match for that draw. It is preferred that the pay value be assigned in such a way that over a statistically significant number of games, the player will tend to get enough zero-value draws to more than negate the value of all positive-value draws. If this is not done, the House will lose money and the game will not be sustainable.

It is also preferred that the value of a particular number match/geometrical match combination be statistically related to and increase with the rarity of that combination or set of combinations, as this makes the game more exciting and allows for larger values at the extremes of the possible number of outcomes while allowing small values to be assigned to more common outcomes, which reduces the number of zero-value draws which produce a complete loss for the player.

There is expected to be at least one "player," who is an independent entity making at least one wager, ante, or other form of bet, and at least one "House." The House being the entity which retains the player's wager, etc if the player fails to win anything under the rules of the individual game to which the invention is applied. The description of the preferred embodiment describes a game with only one player (other than the House) but it is neither preferred nor required that this be the case. If more than one player participates, it would be predetermined whether players are playing against other players as well as the House, or whether all players are playing against the House only, and provisions be made for determining the outcome in either event.

Figure 1A:
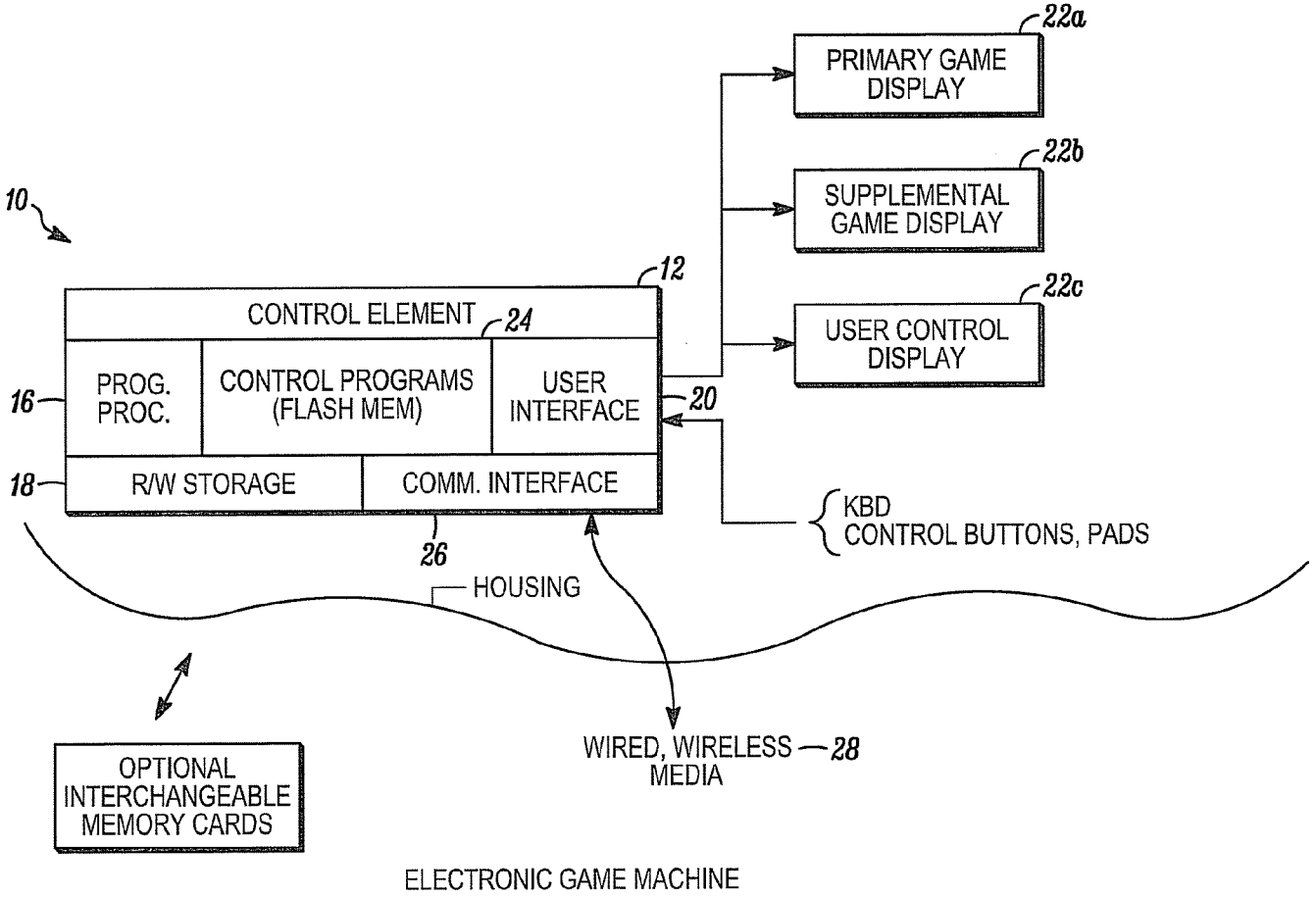
FIG. 1A is a block diagram of the apparatus of FIG. 1 illustrating additional details thereof.

With reference now to the figures, and specifically, FIGS. 1 and 1A, there is shown a gaming apparatus 10 featuring at least one display device 22*a* 22*b* 22*c* such as for example, a flat panel LCD or LED display device, at least one input device 22*d* and a user interface 20. The apparatus further can have at least one programmable processor 16 coupled to the display device 22*a* 22*b* 22*c* and user interface 20, and at least one storage unit 18 coupled to the processor 16. According to embodiments of the subject invention, the storage unit 18 can store a plurality of instructions executable by the programmable processor 16 to present on the display device 22*a* 22*b* 22*c* a plurality of play choices. The instructions can further be configured to receive a player's selection of sub-elements from input devices 22*d* and user interface 20 and evaluate the player's selection of sub-elements to the set of randomly preselected sub-elements from the fixed set of elements. A player's selection of sub-elements can be made either via a touchscreen as is presently known in connection with modern video gaming machines by touching the specific elements that the player wants to select, or by pressing a button that navigates and/or corresponds to particular elements.

According to embodiments of the subject invention, at least one display device, 22*a* 22*b* 22*c*, can be a visual output device configured to provide a visual indicator of the match or game being played. In the embodiment shown in FIG. 1, the gaming apparatus 10 and the game display 22*a* can be configured to display at least one image "I" of a Keno card.

FIG. 2, illustrates an embodiment of the present invention. The player is presented with the Keno Card "I" (comprising the entire FIG. 2.) The card shows all the set of numbers which can be drawn in a simple grid, and has blanks which show the player's selection and the numbers drawn later during play. In the preferred embodiment of the machine incorporating the invention, the card as shown, with additional embellishment as appropriate and customary in the art, would be represented on a touchscreen electronic device, such as the display device 22*a*. As is apparent from FIG. 2, the numbers to be drawn comprise the set of integers from 1 to 64, of which five will be selected by the player and five randomly drawn, the success of the player in selecting the numbers which will be randomly drawn to determine the outcome of the game.

Figure 3:
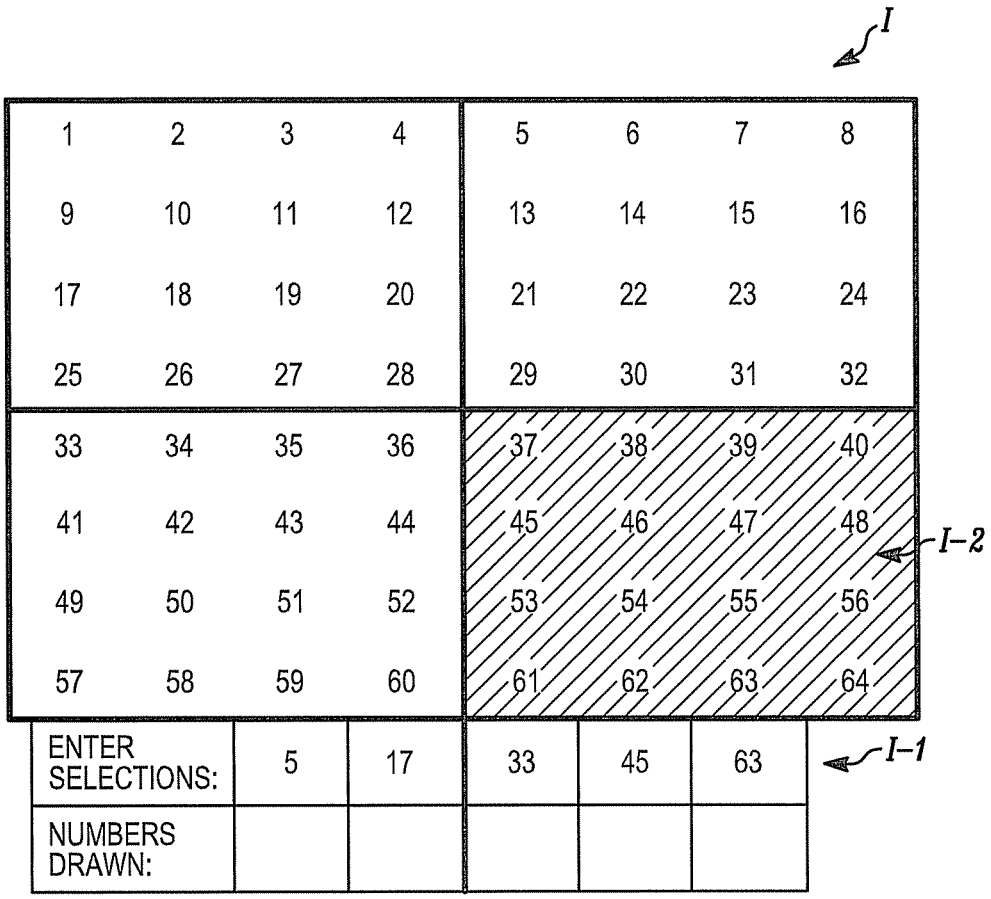
FIG. 3 discloses an intermediate configuration of a keno card showing the player's selection of predicted random numbers from the keno card and the player's selection of a preferred card subarea.

FIG. 3 illustrates the Keno Card "I" after the player has selected the desired numbers, which they would do by any appropriate means. In the preferred embodiment of a machine incorporating the invention, the player would select them by touching the numbers on the touchscreen electronic device. The numbers selected appear in the appropriate boxes "I-1". They could also simply be highlighted or indicated by any appropriate means, or not even indicated at all, although it is preferred that some indication be made.

Furthermore, in the practice of the invention, the player has selected one area "I-2" of the Keno Card for their area wager. The bottom right area of the card is now shaded to indicate that the player has selected it. If a majority, or whatever predetermined threshold is selected, of the numbers drawn are represented in this area, the player wins the area selection wager, and receives the appropriate payback. It is preferred that area selection wagers be separate from numerical selection wagers, although it is not required and could be an additional non-charged step in accepting the total wager.

It is preferred to adjust the paytable of the overall game accordingly depending on whether the area selection wager incurs an additional wager amount requirement on the part of the player. The method of indicating the selected area must be apparent to the player and unambiguous, but its particular implementation is not important: in the preferred embodiment the player simply touches their preferred area selection or selections after confirming their numerical selections. It is unimportant whether the area is selected before, during or after the player's numeric selection step. Both selection steps must occur before the player learns what numbers are randomly selected, but it does not matter whether the numbers are actually randomly selected before or after the player makes their selections. Also, the player may be allowed to select multiple areas, or to select negatively by predicting which areas will not contain a plurality of the selected numbers.

It is also preferred that the paytable be adjusted according to how such choices influence the statistical likelihood of the player's selecting correctly. It is preferred that the player not be allowed to select all areas, as this is a certain outcome in many configurations and if there is any positive payout for such selection, the player will always win. It is possible in some configurations of keno for no one area to get a plurality of selected numbers: in this case, it is allowable to allow all areas to be selected if the paytable is adjusted accordingly since the player could still lose.

In an alternate embodiment, the player does not select an area directly, but rather if the player selects numbers in such a way that the plurality of selected numbers is within a single area, that area is selected. This could again either be a free additional winning possibility or require the payment of an area selection wager by the player. Neither is preferred but it is preferred to select the paytable accordingly.

Figure 4:
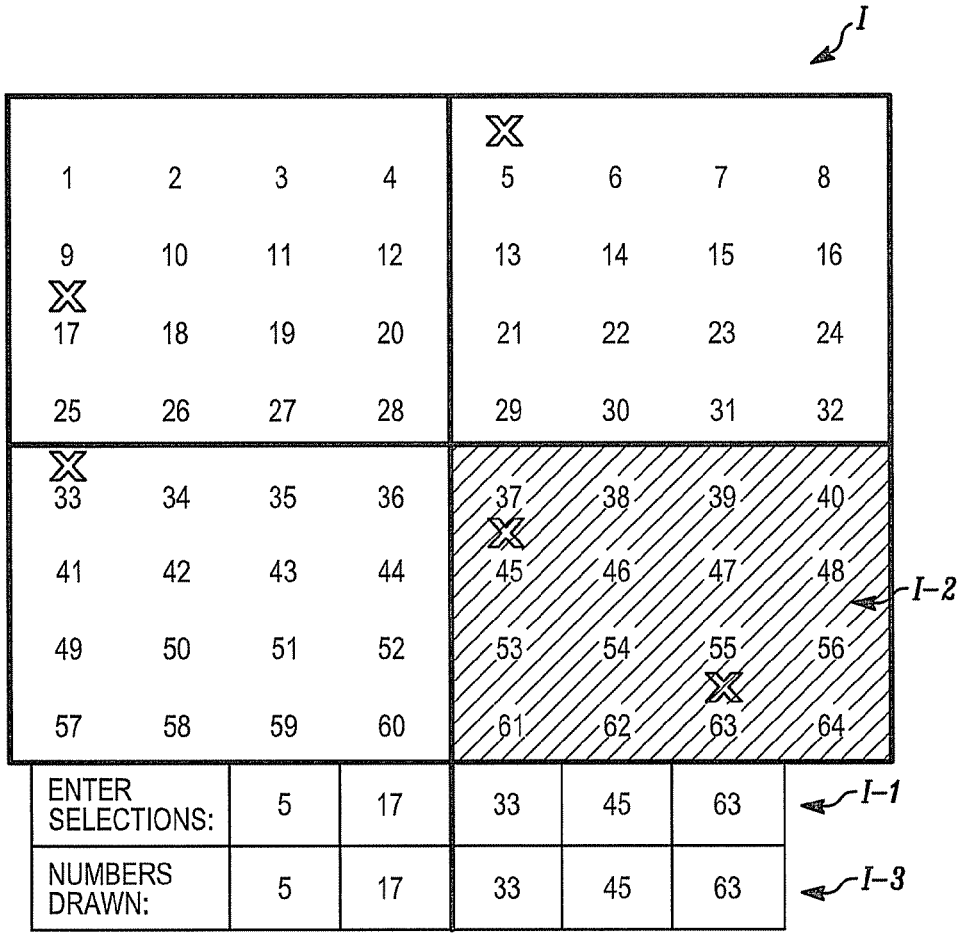
FIG. 4 discloses a first final configuration of a keno card showing a configuration with a winning subarea selection.

FIG. 4 illustrates the Keno Card "I" in a situation in which the player has successfully selected all five numbers drawn "I-3", and so would win the maximum possible payout for the numerical selection wager. The "X" markers indicate the numbers which were drawn and show which area contains them: they are also listed in the appropriate sections at the bottom of the Keno Card. Furthermore, a plurality of the numbers selected were within the area "I-2" selected for the area selection wager, and so the player would also win the area selection wager payout.

Figure 5:
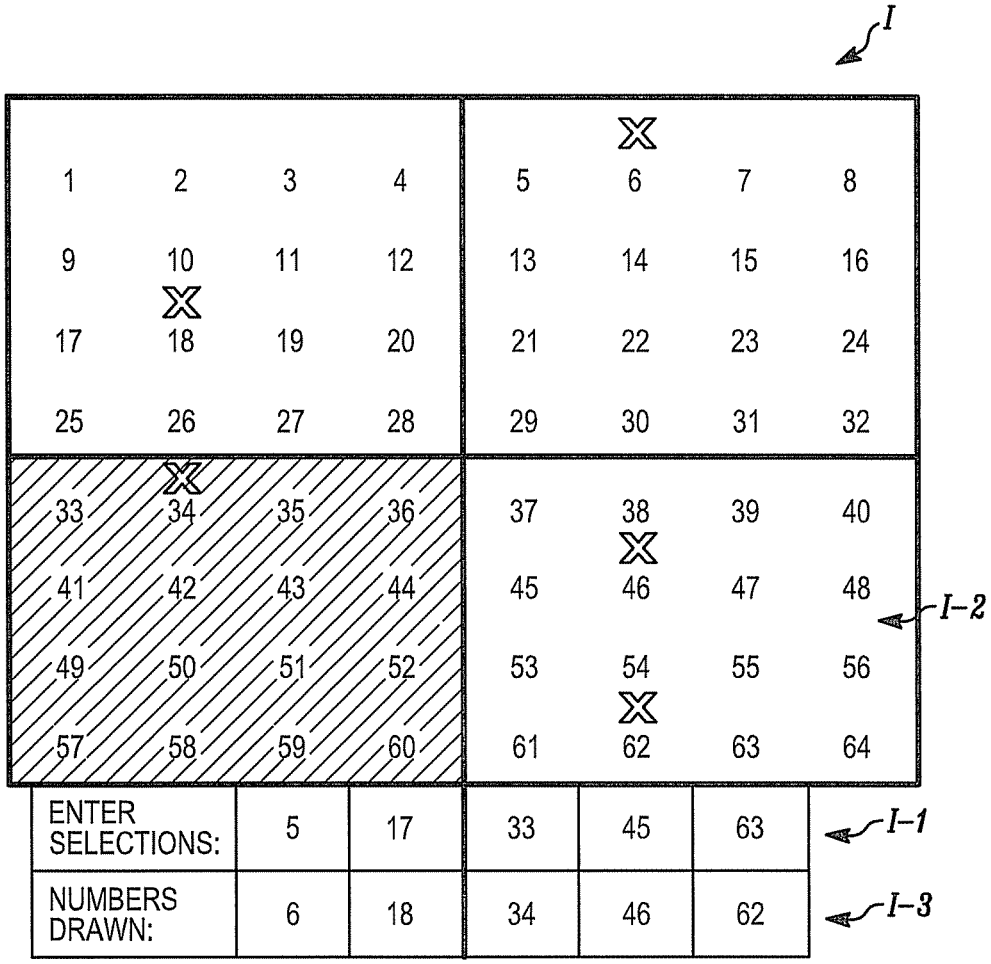
FIG. 5 discloses a second final configuration of a keno card showing a configuration with a losing subarea selection.

FIG. 5 illustrates the Keno Card in a situation in which the player has not successfully selected any of the numbers drawn, and would therefore win the lowest possible payout for the numerical selection wager (normally zero.) The "X"

markers indicate the numbers which were drawn and show which area contains them: they are also listed in the appropriate sections at the bottom of the Keno Card. Furthermore, a plurality of numbers selected were not within the area the player has selected for the area selection wager in this case (shown by the shading in the bottom left area.) Therefore the player would not win the area selection wager payout.

As those of skill will understand, while the description above details the preferred and best mode(s) of practicing the invention, many other configurations and variations are possible. For example, the invention need not be practiced with a commercial gaming unit, but could be used with a variety of coin-operated amusement devices, home gaming systems, or any other appropriate system. Accordingly, the scope of the invention should be determined not by the embodiment(s) illustrated, but by the claims below and their equivalents.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

Further, logic flows depicted in the figures do not require the particular order shown, or sequential order, to achieve desirable results. Other steps may be provided, or steps may be eliminated, from the described flows, and other components may be add to, or removed from the described embodiments.

The invention claimed is:

1. A method for playing a game having both numeric and area selection winning thresholds, comprising:

providing a gaming machine for playing the game, the machine:

presenting on an electronic display of the gaming machine a plurality of distinct elements which are grouped into a plurality of sectors, the sectors being areas on the display containing a grouping of elements from the plurality of distinct elements;

enabling a player to select both a sub-plurality of elements from the plurality of distinct elements and at least one player-selected sector from the plurality of sectors;

selecting a subset of random elements from the plurality of distinct elements, the subset of random elements designating at least one sector of the plurality of sectors, the at least one designated sector determined by the grouping of the distinct elements selected as the subset of random elements;

comparing the subset of random elements to the sub-plurality of player-selected elements and comparing the player-selected sector to the designated sector;

rewarding the player if the subset of random elements and the sub-plurality of player-selected elements have a predetermined minimum number of common elements, and rewarding the player if the at least one player-selected sector corresponds to the designated sector.

2. A method as in claim 1 which includes bounding the distinct plurality of elements to form a single Keno-type display.

3. A method as in claim 2 where the designated sector is the sector having a greatest number of distinct elements in the subset of random elements.

4. A method as in claim 3 which includes displaying a boundary defining each sector, the boundary containing the grouping of elements from the plurality of distinct elements within each sector.

5. A gaming machine for playing a game having both numeric and area selection winning thresholds, comprising:

at least one display device presenting an electronic display;

at least one input device;

a random number generator;

at least one processor coupled to the display device, the input device and the random number generator; and a storage unit containing a set of instructions stored on a computer-readable medium and executable by the processor, the instructions activating the machine to: accept an input from a player through the input device, the input comprising a subset of player selected elements from a plurality of elements and at least one player selected sector from a plurality of sectors, each sector of the plurality of sectors being a region on the display containing a grouping of elements from the plurality of elements; activate the random number generator to select a plurality of distinct elements which designate at least one sectors from the plurality of sectors; compare the player selected elements and the player selected sector against the plurality of distinct elements and the designated sector, and award a prize to the player if the set of distinct elements and the set of player selected elements have a minimum number of common elements and if the player selected sector corresponds to the designated sector.

6. A machine as in claim 5 which includes a touch screen electronic device.

7. A machine as in claim 5 wherein the display device displays a keno card having a set of numbers, a plurality of areas for displaying numbers selected by the player, a visual indication of the player selected sector and visual indicators identifying a plurality of numbers generated by the random number generator.

8. A machine as in claim 5 which includes an adjustable paytable, the set of instructions adjusting the paytable according to the player selected sector.

9. A method for playing a game having both numeric and area selection winning thresholds, comprising:

providing a gaming machine for playing the game, the machine:

presenting on an electronic display of the gaming machine a plurality of individual game elements which are grouped into a plurality of sectors, the sectors being areas on the display containing a subset of the plurality of game elements;

providing a selectable primary play choice comprising at least one element of the plurality of game elements;

providing a selectable secondary play choice comprising at least one subset sector of the plurality of sectors;

randomly selecting at least one game element from the plurality of elements, the at least one randomly selected game element associated with a sector of the plurality of sectors;

comparing the at least one randomly selected game element to the primary play choice and comparing the sector associated with the at least one game element to the secondary play choice;

providing a reward if the at least one randomly selected game element matches the primary play choice or has a pre-determined minimum number of common elements with the primary play choice; and providing a reward if the sector associated with the at least one randomly selected game element matches the secondary play choice or has a pre-determined minimum number of common subsets with the secondary play choice.

10. The method of claim 9 which includes presenting on the electronic display visual indicators designating the primary and secondary play choices.

11. The method of claim 10 which includes presenting the at least one randomly selected game element on the electronic display adjacent the primary play choice.

12. The method of claim 9 which includes presenting a visual indicator on the electronic display, the indicator designating the at least one randomly selected game element.

13. The method of claim 9 where presenting the plurality of individual elements includes presenting numbers grouped into the plurality of sectors, each of which containing an equal quantity of numbers.

14. The method of claim 9 which includes accepting a wager on an outcome of the game.

15. The method of claim 10 where presenting visual indicators includes presenting shading over at least one sector of the plurality of sectors, the shading designating the secondary play choice.

* * * * *